US005903519A

United States Patent [19]

Takahashi et al.

[11] Patent Number: 5,903,519

[45] Date of Patent: May 11, 1999

[54] CALENDAR WATCH

[75] Inventors: Masaaki Takahashi; Mitsuru Ishii, both of Chiba, Japan

[73] Assignee: Seiko Instruments Inc., Japan

[21] Appl. No.: 08/914,253

[22] Filed: Aug. 18, 1997

[51] Int. Cl.[6] ..... G04B 19/20; G04B 19/24

[52] U.S. Cl. ..... 368/35; 368/37

[58] Field of Search ..... 368/28, 31, 34–37, 368/185, 190–199

[56] References Cited

U.S. PATENT DOCUMENTS

| | | | |
|---|---|---|---|
| 3,775,965 | 12/1973 | Besson et al. | 368/35 |
| 4,027,468 | 6/1977 | Felty et al. | 368/35 |
| 4,060,977 | 12/1977 | Rochat | 368/28 |
| 4,127,985 | 12/1978 | Murrle | 368/35 |
| 4,244,038 | 1/1981 | Ganter et al. | 368/37 |
| 4,282,592 | 8/1981 | Miyasaka | 368/37 |

*Primary Examiner*—Vit Miska
*Attorney, Agent, or Firm*—Adams & Wilks

[57] ABSTRACT

A calendar watch comprises a calendar corrector setting wheel disposed on the dial side of a main plate and mounted for oscillation about a center of rotation within a second domain to correct a date indicator and a day corrector. The calendar watch also comprises a date normalizing device disposed on the dial side of the main plate for normalizing the date indicator within a third domain, a day indicator normalizing device for normalizing a day star within the second domain or the third domain, and a date indicator driving device and a day indicator driving device having a center of rotation within a fourth domain. A setting lever and a yoke are disposed on a side of the main plate opposite from the dial side.

10 Claims, 8 Drawing Sheets

CALENDAR WATCH

BACKGROUND OF THE INVENTION

The present invention relates to a calendar watch having a date indicator and a day indicator.

A conventional calendar watch has had a main plate which constitutes a base of a movement and a change-over mechanism such as a setting lever and a yoke has been disposed on the dial side of the main plate. A calendar mechanism has been also disposed on the dial side of the main plate.

Here, the movement means a mechanical body including a mechanical structural and operational parts of a watch. A calendar watch is composed of the mechanical body and casing parts.

Further, a gear train mechanism, an escape speed governor, an automatic winder and the like have been disposed on the side opposite from the dial of the main plate, i.e. on the front side, in the conventional mechanical calendar watch.

A date indicator driving wheel has been incorporated rotatably into a pin of the main plate and has been fixed by a flat screw in the conventional calendar watch.

Further, a date indicator maintaining plate has been fixed to the main plate by a flat screw in the conventional calendar watch.

Further, a foot of the dial has been fixed to the main plate by a horizontal screw or an eccentric pin in the conventional calendar watch.

Further, the pin has been provided on the main plate to hold the position of a day jumper for normalizing a day star in the conventional calendar watch.

Accordingly, the prior art calendar watch has had the following problems:

(1) Because the change-over mechanism overlaps with the calendar mechanism on the dial side of the main plate, the movement becomes large or thick.

(2) Because the date indicator maintaining plate is fixed to the main plate by the flat screw, the head of the screw protrudes out of the upper face of the date indicator maintaining plate, increasing the thickness of the movement.

(3) Because the foot of the dial is fixed to the main plate by the horizontal screw or the eccentric pin, a space for providing the horizontal screw or the eccentric pin is required, increasing the size or thickness of the movement.

(4) The pin for holding a height of the day jumper from the main plate needs to be provided on the main plate, so that the movement becomes large to maintain the space.

SUMMARY OF THE INVENTION

Accordingly, it is an object of the present invention to solve the aforementioned prior art problems by providing:

(1) a small and thin calendar watch;

(2) a thin structure for fixing the date indicator maintaining or support plate firmly to the main plate;

(3) a small structure for fixing the dial firmly to the main plate; and (4) a small and simple structure for holding the height of the day jumper from the main plate without providing any pin.

In order to solve the aforementioned problems, an inventive calendar watch comprises a main plate which constitutes a base of a movement; a center wheel & pinion which rotates centering almost on a center of the main plate as a center of rotation; a winding stem and a clutch wheel for correcting time information; a change-over mechanism including a setting lever and a yoke; a dial for indicating time information; and a date indicator and a day indicator.

Defined on the main plate are a main plate reference vertical axis which passes through the center of rotation of the center wheel & pinion and is almost parallel with the center axis of the winding stem and a main plate reference horizontal axis which passes through the center of rotation of the center wheel & pinion and is vertical to the main plate reference vertical axis. Provided on the main plate are a first domain positioned at one side of the main plate reference vertical axis and at the side closer to the winding stem from the main plate reference horizontal axis; a second domain positioned at the other side of the main plate reference vertical axis and at the side closer to the winding stem from the main plate reference horizontal axis, a third domain positioned on the other side of the main plate reference vertical axis where the second domain is located and at the side farther from the winding stem from the main plate reference horizontal axis, and a fourth domain positioned at one side of the main plate reference vertical axis where the first domain is located and at the side farther from the winding stem from the main plate reference horizontal axis.

The inventive calendar watch further comprises a calendar corrector setting wheel, which is disposed on the dial side of the main plate and is provided oscillably having the center of rotation positioned within the second domain, for correcting the date indicator and the day indicator; date indicator normalizing means, disposed on the dial side of the main plate, for normalizing the date indicator within the third domain; day indicator normalizing means, disposed on the dial side of the main plate, for normalizing a day star of the day indicator within the third domain; date indicator driving means, disposed on the dial side of the main plate and having the center of rotation within the fourth domain, for rotating the date indicator; day indicator driving means, disposed on the dial side of the main plate and having the center of rotation within the fourth domain, for rotating the day indicator; and a setting lever and a yoke disposed on the side opposite from dial of main plate.

Preferably, the inventive calendar watch further comprises a date indicator driving wheel having a date indicator gear section which rotates based on the rotation of the hour wheel, a date indicator axial section provided at the center of one face of the date indicator gear section, a date finger for rotating the date indicator and a day finger for rotating the day indicator, the date indicator axial section being incorporated rotatably in a hole of the main plate; and a date indicator maintaining plate having a date indicator driving wheel holding part for holding at least part of the date indicator driving wheel rotatably to the main plate.

Further, preferably, the inventive calendar watch has day indicator normalizing means provided with a height adjusting section which protrudes toward the main plate around a part for normalizing the day star of the day indicator.

Further, preferably, the inventive calendar watch further comprises a dial stopping member having at least two dial foot holes for pushing in a dial foot of the dial, a dial receiving face for receiving the bottom face of the dial and at least two main plate peripheral projection receiving sections for mating with a peripheral projection of the main plate.

Further, in the inventive calendar watch, preferably the complete barrel, the pallet fork, the escape wheel & pinion, the balance, the yoke and the setting lever are disposed in this order on the side opposite from the dial of the main plate clockwise or counter-clockwise around the center wheel & pinion on the basis of the main plate reference vertical axis.

DETAILED DESCRIPTION OF THE PREFERRED EMBODIMENTS

Figure 1:
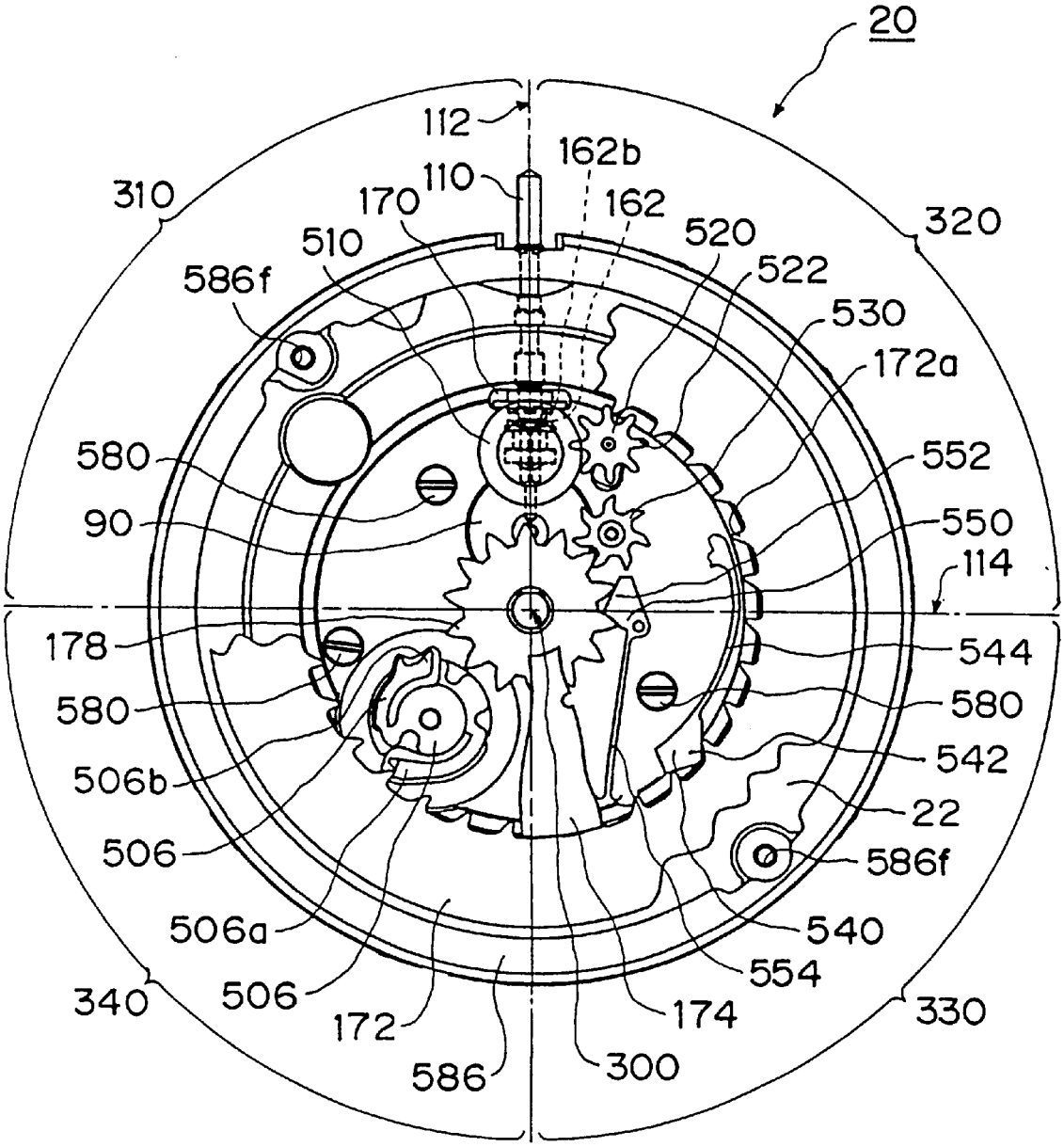
FIG. 1 is a plan view showing a schematic structure of a movement of an inventive calendar watch seen from the front side thereof in which a part of a date indicator, a part of a day indicator and a part of a date indicator holder are not shown in order to clearly show the movement.

A mode for carrying out the invention will be explained below based on the drawings.

(1) Structure of Calendar Mechanism

In FIGS. 1 through 7, there are defined, on a main plate 22 which constitutes a base of a movement, a main plate reference vertical axis 112 which passes through a center of rotation 300 of a center wheel & pinion 24 and a hour wheel 80 and is almost parallel with the center axis of a winding stem 110 and a main plate reference horizontal axis 114 which passes through the center of rotation 300 of the center wheel & pinion 24 and is vertical to the main plate reference vertical axis 112 in the inventive calendar watch.

There is provided, on the main plate 22, a first domain 310 positioned at one side of the main plate reference vertical axis 112 and at the side closer to the winding stem 110 from the main plate reference horizontal axis 114. There is provided, on the main plate 22, a second domain 320 positioned at the other side of the main plate reference vertical axis 112 and at the side closer to the winding stem 110 from the main plate reference horizontal axis 114. There is provided, on the main plate 22, a third domain 330 positioned on the other side of the main plate reference vertical axis 112 where the second domain 320 is located and at the side farther from the winding stem 110 from the main plate reference horizontal axis 114. There is provided, on the main plate 22, a fourth domain 340 positioned at the above-mentioned one side of the main plate reference vertical axis 112 where the first domain 310 is located and at the side farther from the winding stem 110 from the main plate reference horizontal axis 114.

Figure 7:
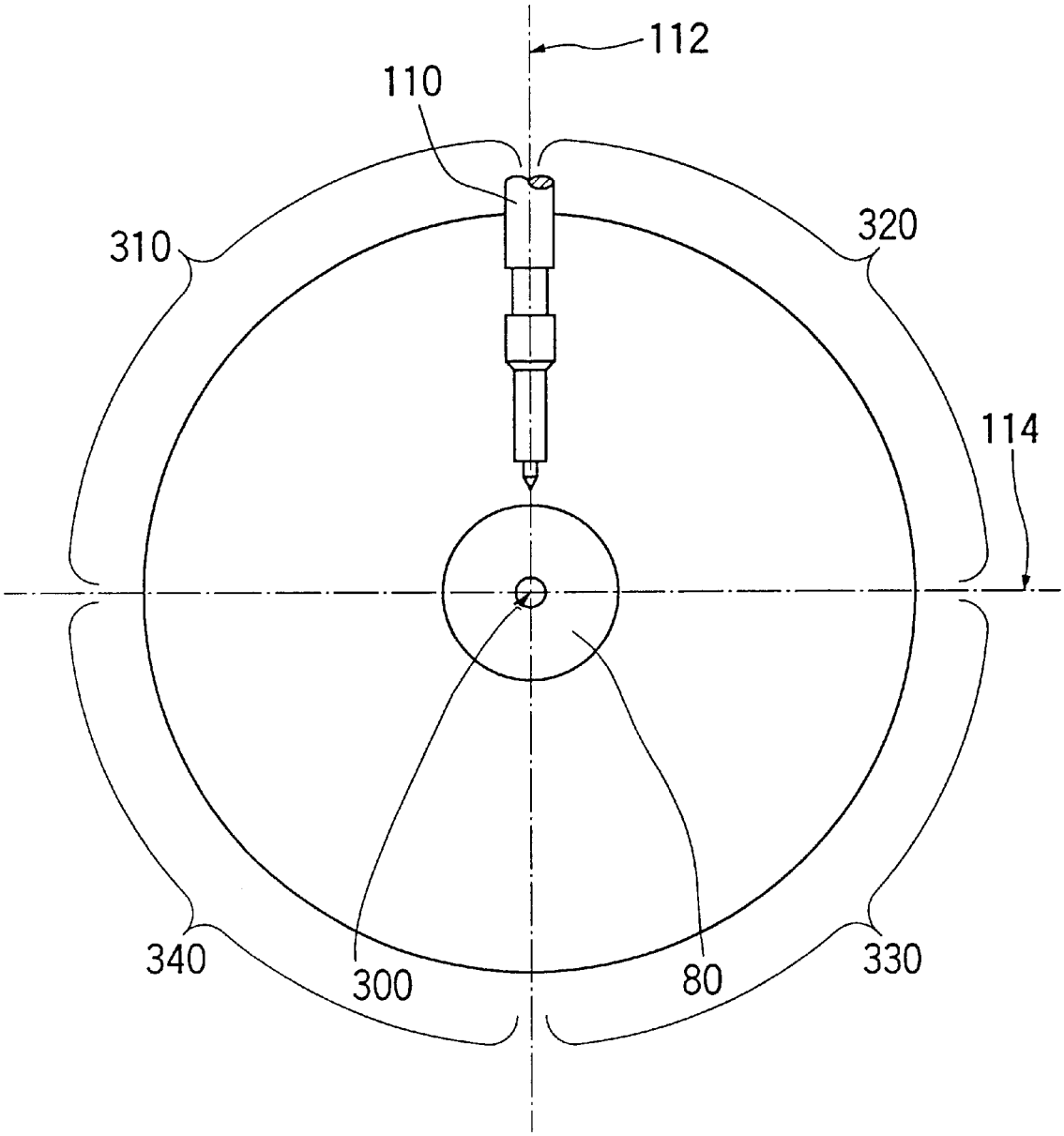
FIG. 7 is a schematic plan view showing sections of four domains of the main plate of the inventive calendar watch.

It is noted that although the first domain 310 and the fourth domain 340 are located on the right side of the main plate reference vertical axis 112 in FIG. 7, those domains may be defined so as to be located on the left side of the main plate reference vertical axis 112. Naturally, the second domain 320 and the third domain 330 should be defined so as to be located on the right side of the main plate reference vertical axis 112 in such a case.

Figure 2:
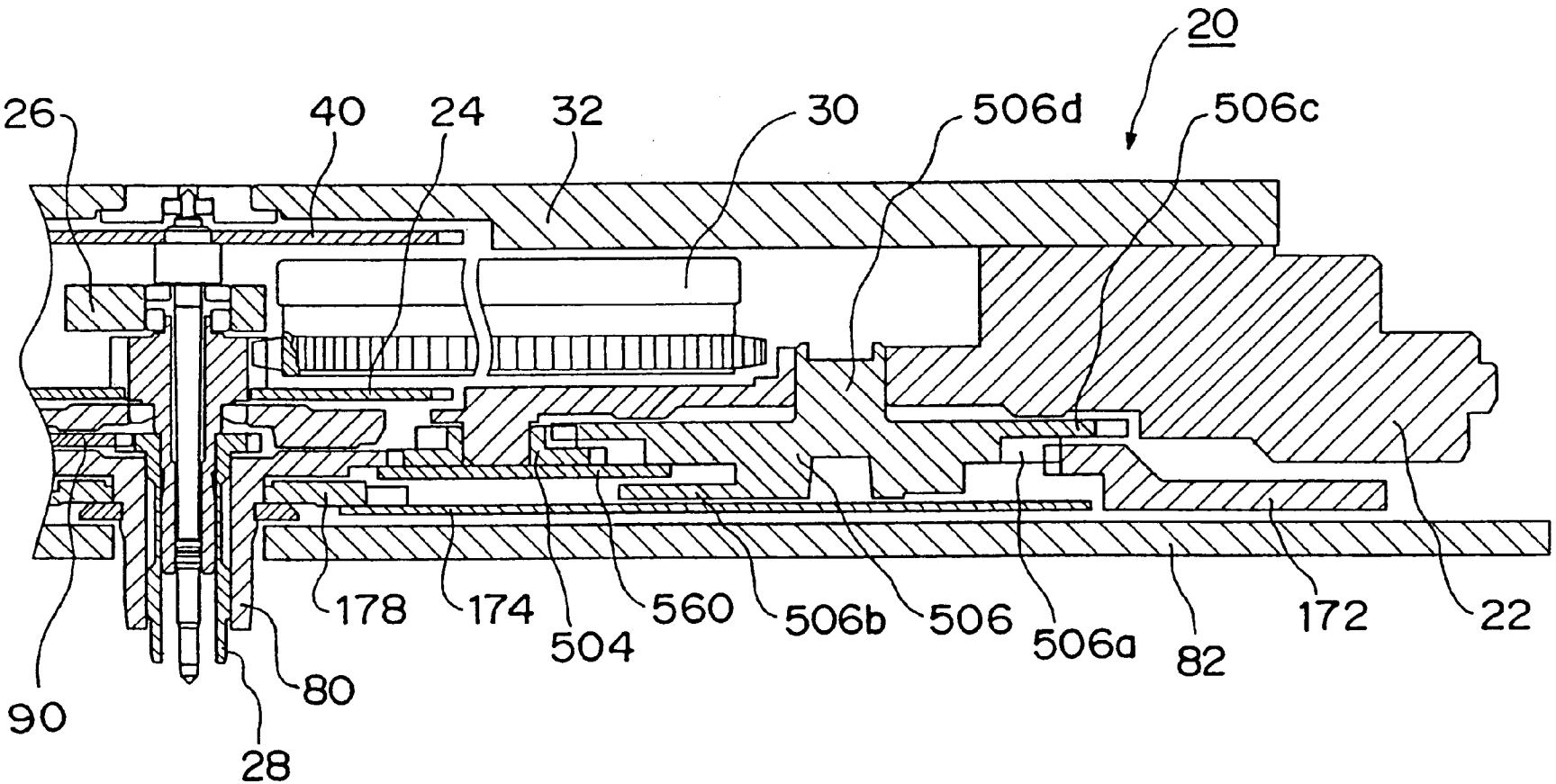
FIG. 2 is a section view showing a schematic structure of a date indicator driving wheel part of the movement of the inventive calendar watch.

In FIGS. 1 and 2, the hour wheel 80 engages with an intermediate date wheel gear of an intermediate date wheel 504. An intermediate date wheel pinion of the intermediate date wheel 504 engages with a date indicator driving wheel 506. A date indicator 172 is incorporated rotatably to the main plate 22. A day indicator 174 is incorporated rotatably to the hour wheel 80. The date indicator 172 is rotated by a date finger 506*a* of the date indicator driving wheel 506. The day indicator 174 is rotated by a day finger 506*b* of the date indicator driving wheel 506.

The date finger 506*a* may be formed in a body with the date indicator driving wheel 506 or separately from the date indicator driving wheel 506. The day finger 506*b* may be formed in a body with the date indicator driving wheel 506 or separately from the date indicator driving wheel 506. The date finger 506*a* may be formed in a body with the day finger 506*b*. The date indicator driving wheel 506 on which the date indicator driving wheel 506 is formed in a body with the day finger 506*b* constitutes date indicator means and day indicator means.

A first calendar corrector 170 engages with a second calendar corrector setting wheel 510. The second calendar corrector setting wheel 510 engages with a calendar corrector setting wheel 520. The calendar corrector setting wheel 520 is incorporated oscillably to a circular long hole (not shown) of the main plate 22. A day corrector transmission wheel 530 is incorporated so as to engage with a day star 178. The calendar corrector setting wheel 520 has a date and day corrector setting gear 522 which is arranged so as to engage with an inner gear section 172*a* of the date indicator 172 at the first position when it oscillates one direction and to engage with the day corrector transmission wheel 530 at the second position when it oscillates in the other direction.

A date jumper 540 is provided within the third domain 330 on the side of the dial 82 of the main plate 22. A date indicator normalizing section 542 of the date jumper 540 engages with the date indicator 172*a* of the date indicator 172 to normalize the rotation of the date indicator 172. A spring portion 544 of the date jumper 540 extends in the direction opposite from the direction in which the date indicator 172 rotates based on the date indicator normalizing section 542. Such arrangement of the spring section 544 allows the date indicator 172 to be rotated smoothly. The date jumper 540 is made of an elastically deformable material. For example, the date jumper 540 is preferably made of phosphor bronze or stainless steel.

In FIG. 1, the date indicator 172 rotates clockwise. The date jumper 540 constitutes date indicator normalizing means for normalizing the date indicator 172. The date jumper 540 may be formed in a body with the date indicator maintaining plate 560 or the date jumper 540 may be formed separately from the date indicator maintaining plate 560.

A day jumper 550 is provided within the second domain 320 or the third domain 330 on the side of the dial 82 of the main plate 22. A day indicator normalizing section 552 of the day jumper 550 engages with the day star 178 of the day indicator 174 to normalize the rotation of the day indicator 174. A spring portion 554 of the day jumper 550 extends in the direction opposite from the direction in which the day indicator 174 rotates based on the day indicator normalizing section 552. Such arrangement of the day jumper spring portion 554 allows the day indicator 174 to be rotated smoothly. The day jumper 550 is made of an elastically deformable material. For example, the day jumper 550 is preferable to be made of phosphor bronze or stainless steel.

In FIG. 1, the day indicator 174 rotates counter-clockwise. The day jumper 550 constitutes day indicator normalizing means for normalizing the day indicator 174. The day jumper 550 may be formed in a body with the date indicator maintaining plate 560 or may be formed separately from the date indicator maintaining plate 560.

When the date indicator maintaining plate 560 is formed in a body with the date jumper 540/day jumper 550, the date indicator maintaining plate 560 is made of an elastically deformable material. In such a case, the date indicator maintaining plate 560 is preferable to be made of phosphor bronze or stainless steel for example.

In FIG. 1, the calendar corrector setting wheel 520 has the center of rotation located within the second domain 320. The date jumper 540 has the date indicator normalizing section 542 for normalizing the date indicator 172 within the third domain 330. The day jumper 550 has the day indicator normalizing section 552 for normalizing the day star 178 of the day indicator 174 within the second domain 320 or the third domain 330. The center of rotation of the date indicator driving wheel 506 is located within the fourth domain 340. The center of rotation of the date finger 506*a* is also located within the fourth domain 340. The center of rotation of the day finger 506*b* is also located within the fourth domain 340.

Further, preferably, the date indicator normalizing section 542 of the date jumper 540 is located around the middle of the circumferential direction within the third domain 330.

Preferably, the day indicator normalizing section 552 of the day jumper 550 is located around the boundary of the second domain 320 and the third domain 330.

Further, preferably, the center of rotation of the date indicator driving wheel 506, the center of rotation of the date finger 506*a* and the center of rotation of the day finger 506*b* are located around the middle of the circumferential direction within the fourth domain 340, respectively.

Next, an operation of the calendar mechanism of the inventive calendar watch will be explained.

The hour wheel 80 rotates once in 12 hours based on the rotation of the front gear train. The intermediate date wheel 504 rotates based on the rotation of the hour wheel 80. The date indicator driving wheel 506 rotates once in 24 hours based on the rotation of the intermediate date wheel 504. The date indicator 172 is rotated once a day by a portion of one day of date by the date finger 506*a*. The rotation of the date indicator 172 is normalized by the date jumper 540. The day indicator 174 is rotated once a day by a portion of one day of the week by the day finger 506*b*.

As shown in FIG. 1, according to the mode of the present invention, a number of teeth of the day star 178 is 14. In such a case, two gears of the day star 178 must be fed per day by the day finger 506*b*. According to the mode of the present invention, the day finger 506*b* has two edges to feed the teeth of the day star 178. It may be also one edge. The rotation of the day indicator 174 is normalized by the day jumper 550.

When a date and a day are to be corrected, the winding stem 110 is pulled out to the first stage. A gear A 162*b* of the clutch wheel 162 engages with the first calendar corrector 170. When the clutch wheel 162 rotates in a body with the winding stem 110, the first calendar corrector 170 rotates. Due to the rotation of the first calendar corrector 170, the second calendar corrector setting wheel 510 rotates. Due to the rotation of the second calendar corrector setting wheel 510, the calendar corrector setting wheel 520 oscillates within the circular long hole on the main plate 22.

When the winding stem 110 is rotated and the calendar corrector setting wheel 520 is oscillated counter-clockwise, a part of the calendar corrector setting wheel 520 contacts with one end of the circular long hole of the main plate 22. The date indicator 172 is corrected by rotating the calendar corrector setting wheel 520 further in this state.

When the winding stem 110 is rotated and the calendar corrector setting wheel 520 is oscillated clockwise on the other hand, the part of the calendar corrector setting wheel 520 contacts with the other end of the circular long hole of the main plate 22. The day indicator 174 is corrected via the day corrector transmission wheel 530 by rotating the calendar corrector setting wheel 520 further in this state.

(2) Structure of Date Indicator Driving Wheel

In FIGS. 1 and 2, the date indicator driving wheel 506 is provided with a date indicator gear section 506*c* which rotates based on the rotation of the hour wheel 80 and a date indicator axial section 506*d* provided at the center of the face of the date indicator gear section 506*c* on the side where the main plate 22 is located. The date indicator driving wheel 506 is provided with the date finger 506*a* for driving the date indicator 172 and the day finger 506*b* for driving the day indicator 174. The date indicator driving wheel 506 is incorporated rotatably into a day indicator driving wheel assembly hole.

A part of the date indicator maintaining plate 560 has a day indicator driving wheel holding section for holding at least part of the date indicator driving wheel 506 rotatably to the main plate 22. Such arrangement allows the date indicator driving wheel 506 to be held to the main plate 22 with a simple structure without using any flat screw.

Preferably, the date indicator driving wheel 506 is made of plastic such as polyacetal. It allows the date indicator driving wheel 506 to be manufactured readily and the date indicator driving wheel 506 to be rotated smoothly.

(3) Structure of Day Jumper

Figure 3:
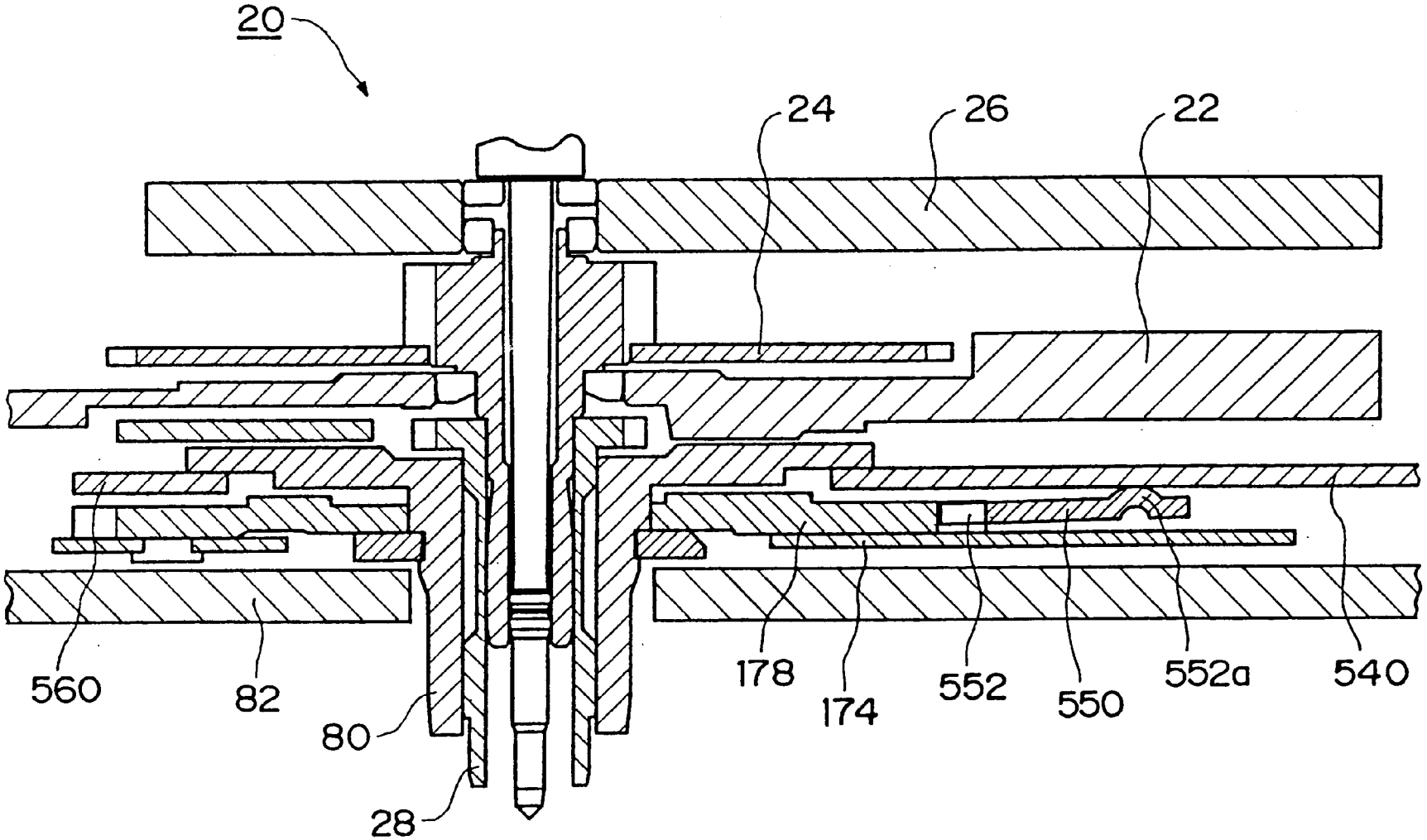
FIG. 3 is a section view showing a schematic structure of a day jumper part of the movement of the inventive calendar watch.

In FIG. 3, a height adjuster 552*a* which projects toward the main plate 22 is provided around the day indicator normalizing section 552 of the day jumper 550. When the day jumper 550 is incorporated and the day indicator normalizing section 552 engages with the day star 178, the height adjusting section 552*a* runs on a part of the date jumper 540. It is also possible to arrange such that the height adjusting section 552*a* runs on a part of the date indicator maintaining plate 560. Or, it is possible to arrange such that the height adjusting section 552*a* runs on a part of the day jumper 550. Such arrangement allows the day indicator normalizing section 552 to engage firmly with the day star 178.

It is noted that instead of providing the height adjusting section 552*a* on the day jumper 550, it is possible to provide a bridge height adjuster (not shown) which projects toward the dial 82 on part of the date jumper 540. Preferably, the height adjusting section 552*a* or the bridge height adjuster is formed of a part of nearly a semi-spherical shape. Such shape allows the day indicator normalizing section 552 of the day jumper 550 to be readily incorporated and the day jumper 550 to be operated reliably.

(4) Structure for Fixing Date Indicator Maintaining Plate

Figure 4:
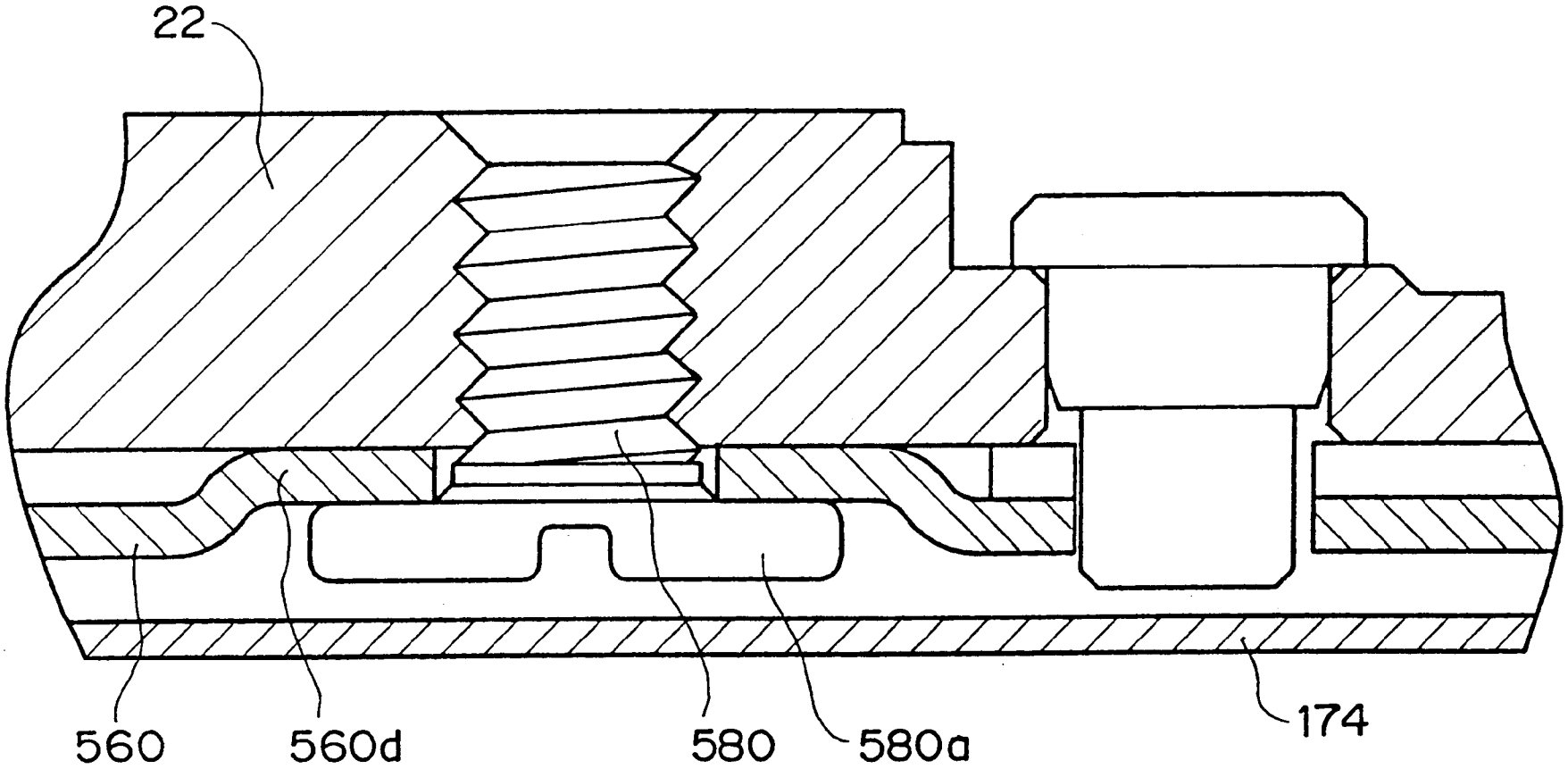
FIG. 4 is a section view showing a schematic structure of a date indicator maintaining screw part of the movement of the inventive calendar watch.

In FIG. 4, a date indicator maintaining step 560*d* is provided at part of the date indicator maintaining plate 560. The date indicator maintaining step 560*d* is provided so as to be depressed toward the main plate 22. Preferably, the date indicator maintaining step 560*d* is made by way of drawing. The date indicator maintaining step 560*d* may be made by way of bending. The date indicator maintaining step 560*d* may be made by compressing without bending it.

The date indicator maintaining plate 560 is fixed to the main plate 22 by incorporating a date indicator maintaining set screw 580 to the date indicator maintaining step 560*d*. In this structure, a part of thickness of a head 580*a* of the date indicator maintaining set screw 580 enters the date indicator maintaining step 560*d*. Accordingly, the whole thickness of the head 580*a* of the date indicator maintaining set screw 580 will not protrude out of the surface of the date indicator maintaining plate 560.

The head of the date indicator maintaining set screw 580 will not protrude out of the surface of the date indicator maintaining plate 560 by setting the step of the date indicator maintaining step 560*d* to be greater than the thickness of the head of the date indicator maintaining set screw 580. Accordingly, this arrangement allows the calendar watch to be manufactured thinly.

It is preferable to provide two or more date indicator maintaining set screws 580. It is specially preferable to provide three date indicator maintaining set screws 580. Preferably, at least one of the date indicator maintaining set screws 580 is located within the first domain 310. When the day jumper 550 is formed separately from the date indicator maintaining plate 560, the date jumper 540 and the day jumper 550 are preferable to be fixed to the main plate 22 by the date indicator maintaining set screws 580 together with the date indicator maintaining plate 560.

(5) Structure for Fixing Dial

Figure 5:
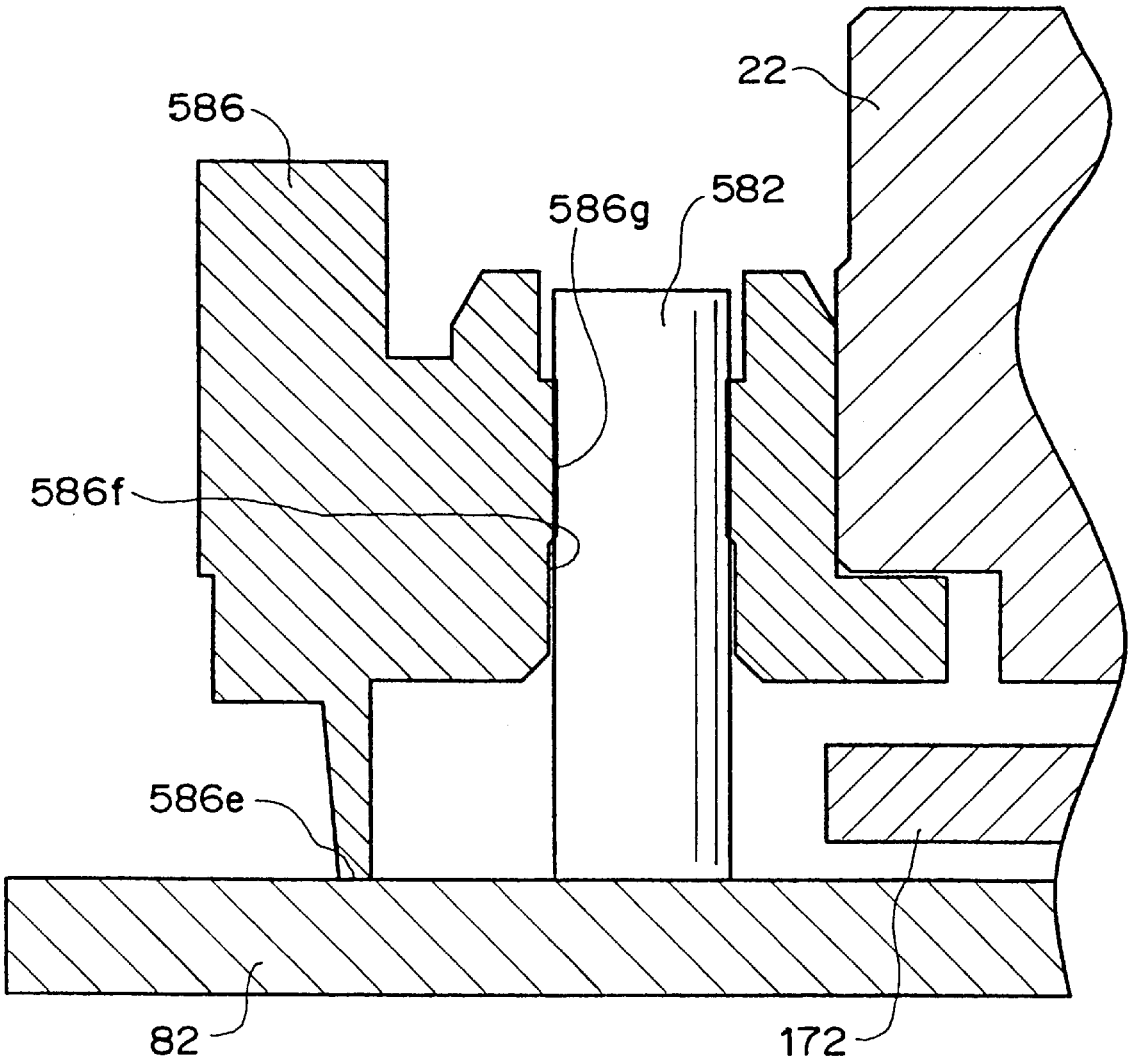
FIG. 5 is a section view showing a schematic structure of a dial foot and dial stopping seat part of the movement of the inventive calendar watch.
Figure 6:
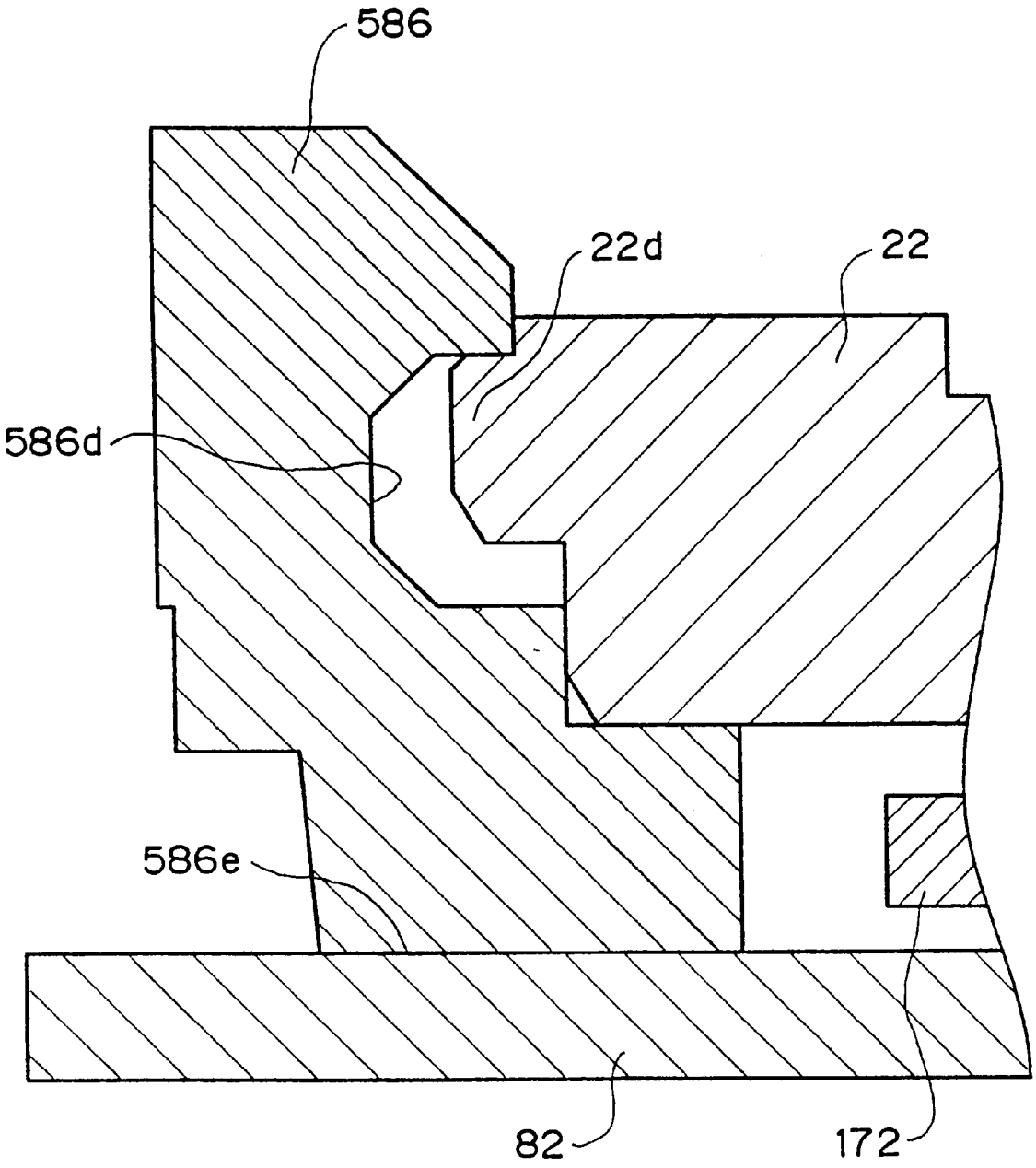
FIG. 6 is a section view showing a schematic structure of a main plate and dial stopping seat part of the movement of the inventive calendar watch.

In FIGS. 1, 5 and 6, a dial stopping member 586 is incorporated at the peripheral portion of the main plate 22. A peripheral projection 22*d* of the main plate 22 is fitted to a main plate peripheral projection receiving section 586*d* of the dial stopping member 586. It is preferable to provide a plural number of peripheral projections 22*d* of the main plate 22 and of main plate peripheral projection receiving sections 586*d* of the dial stopping member 586. It is preferable to provide three or more main plate peripheral projection receiving sections 586*d* and is more preferable to provide six or eight of them.

Preferably, the peripheral projection 22*d* of the main plate 22 is provided in a shape of crescent which projects outwardly in the radial direction from the outer periphery of the main plate 22. Such shape allows the peripheral projection 22*d* of the main plate 22 to be incorporated very easily to the main plate peripheral projection receiving section 586*d* and there is less possibility that they are disconnected after the incorporation.

Preferably, the connection of the peripheral projection 22*d* of the main plate 22 and the main plate peripheral projection receiving section 586*d* in the radial direction is from about 0.1 mm to about 1 mm. More preferably, the connection of the peripheral projection 22*d* of the main plate 22 and the main plate peripheral projection receiving section 586*d* in the radial direction is about 0.2 mm to about 0.4 mm. Such arrangement allows the peripheral projection 22*d* of the main plate 22 to be readily incorporated to the main plate peripheral projection receiving section 586*d* of the dial stopping member 586 and there is less possibility that they are disconnected after the incorporation.

A dial receiving face 586*e* of the dial stopping member 586 receives the bottom face of the dial 82. Preferably, the dial stopping member 586 is made of plastic such as polyacetal and polycarbonate. The peripheral projection 22*d* of the main plate 22 may be readily received because the dial stopping member 586 deforms outwardly in the radial direction when the main plate 22 is incorporated to the dial stopping member 586 by manufacturing the dial stopping member 586 as described above. Further, the use of the plastic allows the dial stopping member 586 to be manufactured at low cost.

The dial foot 582 of the dial 82 is pushed into a dial foot hole 586*f* of the dial stopping member 586. Preferably, a plural number of dial feet 582 and the dial foot holes 586*f* are provided. More preferably, two dial feet 582 and two dial foot holes 586*f* are provided.

An inner diameter of the dial foot hole 586*f* around a middle section 586*g* in the depth direction is smaller than other parts. The dial foot 582 is fitted firmly to the dial foot hole 586*f* by the middle section 586*g* in the depth direction. Preferably, a chamfer length of the middle section 586*g* in the depth direction in the axial direction is about 0.3 mm to about 1 mm.

Preferably, at least one of the dial foot hole 586*f* is a long hole. Preferably, an interference of the engagement of a long side portion of the long hole and the dial foot 582 is about 10 $\mu$m to about 100 $\mu$m.

Figure 8:
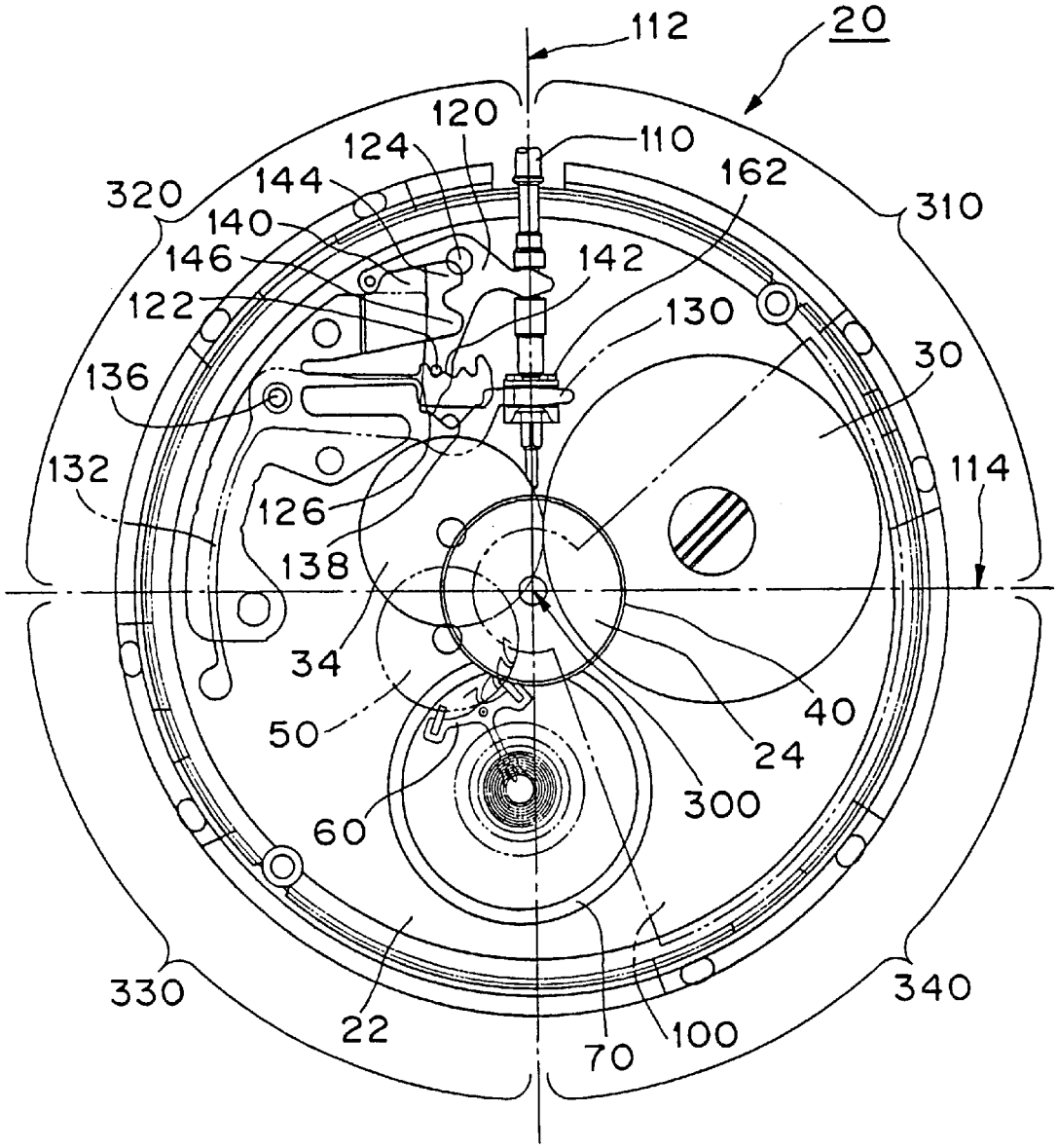
FIG. 8 is a plan view showing the schematic structure of the movement of the inventive calendar watch seen from the front side of the movement in which a bridging member and the like are not shown in order to clearly show the structure.

(6) Structure of Front Gear Train, Escape Speed Governor and Change-Over Mechanism In FIGS. 2 and 8, according to the mode of the mechanical watch of the inventive calendar watch, a front gear train such as a complete barrel, a center wheel & pinion, a third wheel & pinion and a second wheel & pinion, and a change-over mechanism such as a setting lever and a yoke are incorporated on the side opposite from the dial side, i.e. the front side, of the movement 20.

"The opposite side from the dial side of the movement" will be referred to as "the front side of the movement" in general because when a casing structure having a back lid (not shown) is used, the front side of the movement 20 is normally seen when the back lid is removed.

The inventive calendar watch may be also applied to a casing structure having no back lid as a matter of course, so that it is not intended to limit the present invention to the casing structure of the calendar watch having a back lid.

The center wheel & pinion 24 is rotatably incorporated almost at the center of the main plate 22. The cannon pinion 28 is incorporated on the dial side of the main plate 22 so as to be able to slip at the peripheral portion adjacent to an edge closer to a hand attaching part of the center wheel & pinion 24. The cannon pinion 28 rotates in a body with the center wheel & pinion 24.

The complete barrel 30 is incorporated rotatably to the main plate 22. A gear of the complete barrel 30 engages with the cannon pinion 28. The third wheel & pinion 34 is incorporated rotatably to the main plate 22. A second gear of the center wheel & pinion 24 engages with a third pinion. The second wheel & pinion 40 is incorporated rotatably to the main plate 22. A third gear of the third wheel & pinion 34 engages with a fourth pinion of the second wheel & pinion 40.

An escape wheel & pinion 50 is rotatably incorporated to the main plate 22. A fourth gear of the second wheel & pinion 40 engages with an escape pinion of the escape wheel & pinion 50. A pallet fork 60 is incorporated oscillably to the main plate 22. A balance 70 is incorporated rotatably to the main plate 22.

The hour wheel 80 is incorporated rotatably on the main plate 22 on the side where the dial 82 is located. A minute wheel 90 is incorporated rotatably on the main plate 22 on the side where the dial 82 is located. A minute wheel gear of the minute wheel 90 engages with the cannon pinion 28. A minute pinion of the minute wheel 90 engages with the hour wheel 80.

In FIG. 8, the positions of the first domain 310, the second domain 320, the third domain 330 and the fourth domain 340 of the main plate 22 are mirror-symmetrical to the arrangement of each domain shown in FIG. 1 on the basis of the main plate reference vertical axis 112 when the movement 20 is seen from the dial side.

That is, each domain on the front side of the main plate 22 and each domain on the dial side are provided so as to correspond each other.

The center of rotation of the complete barrel 30 is located within the first domain 310. Such arrangement allows the spring having a large torque and is capable of operating for a long duration to be disposed effectively on the front side of the movement.

The center of rotation of the complete barrel 30 may be disposed also within the fourth domain 340.

The center of rotation of the escape wheel & pinion 50 is located within the third domain 330. The center of oscillation of the pallet fork 60 is located within the third domain 330. The center of rotation of the balance 70 is located within the third domain 330. Such arrangement allows the large complete barrel to be used. Such arrangement also allows the large balance having an excellent time accuracy and a large moment of inertia to be disposed effectively on the front side of the movement.

The center of rotation of the balance 70 may be disposed also within the fourth domain 340.

The center of oscillation of the pallet fork 60 and the center of rotation of the balance 70 may be disposed also within the fourth domain 340.

The center of rotation of the escape wheel & pinion 50, the center of oscillation of the pallet fork 60 and the center of rotation of the balance 70 may be disposed also within the fourth domain 340. Such arrangement allows the large third wheel & pinion to be disposed effectively on the front side of the movement.

The center of oscillation 124 of the setting lever 120 is located within the second domain 320. The center of oscillation of the yoke 130 is located within the second domain 320. The setting lever 120 and the yoke 130 are incorporated on the front side of the main plate 22. The yoke holder 140 presses parts of the setting lever 120 and the yoke 130, respectively, toward the main plate 22. The yoke holder 140 is made of an elastically deformable material and is preferable to be made of stainless steel for example. The yoke 130 is made of an elastically deformable material and is preferable to be made of stainless steel for example.

A spring portion 132 of the yoke 130 is located within the second domain 320 and the third domain 330. Such arrangement allows the long spring to be disposed effectively on the front side of the movement. The spring part 132 of the yoke 130 may be disposed only within the second domain 320. The shape of the yoke spring part 132 may be either straight, in bow or in U-shape.

An angle part 142 of the yoke holder 140 engages with a positioning pin 122 of the setting lever 120, thus positioning the setting lever 120 and setting a change-over weight of the winding stem 110. The angle part 142 of the yoke holder 140 is arranged so that the winding stem 110 may be pulled out to a first stage and a second stage in the inventive automatic watch. A guide valley section 138 of the yoke 130 is pressed against the side face of the edge of the setting lever 120 by force of the spring part 132 of the yoke 130.

The center of rotation of the second wheel & pinion 40 which operates to indicate seconds is the same with the center of rotation 300 of the center wheel & pinion 24. That is, the embodiment of the present invention is a three-center-hand watch. The center of rotation of the second wheel & pinion 40 may be disposed at the position different from the center of rotation 300 of the center wheel & pinion 24.

The third wheel & pinion 34 transmits the rotation of the center wheel & pinion 24 to the second wheel & pinion 40. The center of rotation of the third wheel & pinion 34 is located within the second domain 320. Such arrangement allows the large third wheel & pinion 34 to be disposed effectively on the front side of the movement.

The center of rotation of the third wheel & pinion 34 may be disposed within the third domain 330.

Here, a number of gear trains is not limited to those described above and one or more transmission wheels may be added.

It is noted that although it is preferable to dispose each part described above in the arrangement as shown in FIG. 8, it is possible to dispose them so as to be arranged mirror-symmetrically from the arrangement shown in FIG. 1 with respect to the main plate reference vertical axis 112.

Further, in the inventive calendar watch, the complete barrel 30, the pallet fork 60, the escape wheel & pinion 50, the balance 70, the setting lever 120 and the yoke 130 are disposed in this order on the front side of the main plate 22 clockwise around the center wheel & pinion 24 on the basis of the main plate reference vertical axis 112 as shown in FIG. 8. Then, the center of rotation of the pallet fork 60 and the center of rotation of the escape wheel & pinion 50 are disposed at the position closer to the center of rotation 300 of the center wheel & pinion 24 rather than the center of rotation of the balance 70.

In the inventive calendar watch, the complete barrel 30, the pallet fork 60, the escape wheel & pinion 50, the balance 70, the setting lever 120 and the yoke 130 may be also disposed in this order on the front side of the main plate 22 counter-clockwise around the center wheel & pinion 24 on the basis of the main plate reference vertical axis 112 so that they are arranged mirror-symmetrically to the arrangement shown in FIG. 8. Then, the center of rotation of the pallet fork 60 and the center of rotation of the escape wheel & pinion 50 are disposed at the position closer to the center of rotation 300 of the center wheel & pinion 24 rather than the center of rotation of the balance 70 also in this arrangement.

A part of the winding stem 110 and a part of the balance 70 are positioned so as to be almost opposite each other with respect to the main plate reference horizontal axis 114. A part of the complete barrel 30 and a part of the yoke 130 are positioned so as to be almost opposite each other with respect to the main plate reference vertical axis 112. A part of the complete barrel 30 and a part of the third wheel & pinion 34 are positioned so as to be almost opposite each other with respect to the main plate reference vertical axis 112. The center of rotation of the escape wheel & pinion 50 and the center of rotation of the third wheel & pinion 34 are positioned so as to be almost opposite each other with respect to the main plate reference horizontal axis 114.

The complete barrel 30 is rotated by force of the spring (not shown). The center wheel & pinion 24 is rotated as the complete barrel 30 rotates. The third wheel & pinion 34 is rotated as the center wheel & pinion 24 rotates. The second wheel & pinion 40 is rotated as the third wheel & pinion 34 rotates. The cannon pinion 28 is rotated in the same time as the center wheel & pinion 24 rotates. The minute wheel 90 is rotated as the cannon pinion 28 rotates. The hour wheel 80 is rotated as the minute wheel 90 rotates. The rotational speed of each of the gear train is controlled by the operation of the balance 70, the pallet fork 60 and the escape wheel & pinion 50. As a result, the second wheel & pinion 40 rotates once in one minute. The cannon pinion 28 and the center wheel & pinion 24 rotate once in one hour. The hour wheel 80 rotates once in 12 hours.

"Second" is indicated by a second hand (not shown) attached to the second wheel & pinion 40. "Minute" is indicated by a minute hand (not shown) attached to the cannon pinion 28. "Hour" is indicated by a hour hand (not shown) attached to the hour wheel 80. That is, the second wheel & pinion 40, the cannon pinion 28, the center wheel & pinion 24 and the hour wheel 80 compose indicating wheels for indicating time information. The time is read by a scale or the like on the dial 82.

While the inventive calendar watch has been explained with respect to the mechanical watch in the mode described above, the present invention may be applied to an automatic watch or to an electronic watch such as a quartz watch.

Because the calendar watch is arranged as described above according to the present invention, the following effects are brought about:

(1) A small and thin calendar watch may be realized because the calendar mechanism does not overlap with the change-over mechanism;

(2) The day indicator maintaining plate may be firmly fixed to the main plate with the thin and simple structure;

(3) The dial may be fixed to the main plate with a small number of parts; and (4) The height of the day jumper from the main plate may be reliably maintained.

What is claimed is:

1. A calendar watch comprising:

a main plate defining a base of a movement;

a dial disposed on a first side of the main plate for displaying time information;

a center wheel and pinion mounted for rotation about a center of rotation thereof corresponding to a center of the main plate;

a winding stem and a clutch wheel for correcting the time information;

a change-over mechanism including a setting lever and a yoke disposed on a second side of the main plate opposite to the first side thereof;

a date indicator;

date indicator driving means disposed on the first side of the main plate for rotating the date indicator;

date indicator normalizing means disposed on the first side of the main plate for normalizing the date indicator;

a day indicator;

day indicator driving means disposed on the first side of the main plate for rotating the day indicator;

day indicator normalizing means disposed on the first side of the main plate for normalizing a day star of the day indicator; and a calendar corrector setting wheel disposed on the first side of the main plate and mounted for oscillation about a center of rotation for correcting the date indicator and the day indicator;

wherein the main plate has a reference vertical axis passing through the center of rotation of the center wheel and pinion and extending generally parallel to a center axis of the winding stem, a reference horizontal axis passing through the center of rotation of the center wheel and pinion and extending generally vertical to the reference vertical axis, a first domain positioned at a first side of the reference vertical axis and extending in a direction toward the winding stem from the reference horizontal axis, a second domain positioned at a second side of the reference vertical axis opposite the first side and extending in a direction toward the winding stem from the reference horizontal axis, a third domain positioned at the second side of the reference vertical axis and extending in a direction away from the winding stem from the reference horizontal axis, and a fourth domain positioned at the first side of the reference vertical axis and extending in a direction away from the winding stem from the reference horizontal axis, the center of rotation of the calendar corrector setting wheel being positioned within the second domain, the date indicator normalizing means normalizing the date indicator within the third domain, the day indicator normalizing means normalizing the day star of the day indicator within the third domain, the date indicator driving means having a center of rotation disposed within the fourth domain, and the day indicator driving means having a center of rotation disposed within the fourth domain.

2. A calendar watch according to claim 1; further comprising an hour wheel; a date indicator driving wheel having a date indicator gear section for rotation based on the rotation of the hour wheel, a date indicator axial section disposed at the center of one surface of the date indicator gear section and mounted rotatable in a hole of the main plate, a date finger for rotating the date indicator, and a day finger for rotating the day indicator; and a date indicator support plate having a date indicator driving wheel holding part for rotatable holding at least part of the date indicator driving wheel to the main plate.

3. A calendar watch according to claims 1 or 2; wherein the day indicator normalizing means has a height adjusting section protruding toward the main plate for normalizing the day star of the day indicator.

4. A calendar watch according to claim 3; further comprising a dial stopping member for pushing in a dial foot of the dial and having at least two dial foot holes, a dial receiving face for receiving a lower surface of the dial, and at least two main plate peripheral projection receiving sections for mating with a peripheral projection of the main plate.

5. A calendar watch according to claim 4; further comprising: a barrel member for rotationally driving the center wheel and pinion; and a pallet fork, a balance and an escape wheel and pinion for controlling a rotational speed of the center wheel and pinion; wherein the barrel member, the pallet fork, the escape wheel and pinion, the balance, the yoke and the setting lever are disposed in this order on the second side of the main plate clockwise or counterclockwise around the center wheel and pinion on the basis of the reference vertical axis.

6. A calendar watch according to claim 1; further comprising a dial stopping member for pushing in a dial foot of the dial and having at least two dial foot holes, a dial receiving face for receiving a lower surface of the dial, and at least two main plate peripheral projection receiving sections for mating with a peripheral projection of the main plate.

7. A calendar watch according to claim 2; further comprising a dial stopping member having for pushing in a dial foot of the dial and having at least two dial foot holes, a dial receiving face for receiving a lower surface of the dial and at least two main plate peripheral projection receiving sections for mating with a peripheral projection of the main plate.

8. A calendar watch according to claim 1; further comprising: a barrel member for rotationally driving the center wheel and pinion; and a pallet fork, a balance and an escape wheel and pinion for controlling a rotational speed of the center wheel and pinion; wherein the barrel member, the pallet fork, the escape wheel and pinion, the balance, the yoke and the setting lever are disposed in the named order on the second side of the main plate clockwise or counter-clockwise around the center wheel and pinion on the basis of the reference vertical axis.

9. A calendar watch according to claim 2; further comprising: a barrel member for rotationally driving the center wheel and pinion; and a pallet fork, a balance and an escape wheel and pinion for controlling a rotational speed of the center wheel and pinion; wherein the barrel member, the pallet fork, the escape wheel and pinion, the balance, the yoke and the setting lever are disposed in the named order on the second side of the main plate clockwise or counter-clockwise around the center wheel and pinion on the basis of the reference vertical axis.

10. A calendar watch according to claim 3; further comprising: a barrel member for rotationally driving the center wheel and pinion; and a pallet fork, a balance and an escape wheel and pinion for controlling a rotational speed of the center wheel and pinion; wherein the barrel member, the pallet fork, the escape wheel and pinion, the balance, the yoke and the setting lever are disposed in the named order on the second side of the main plate clockwise or counter-clockwise around the center wheel and pinion on the basis of the reference vertical axis.

* * * * *

UNITED STATES PATENT AND TRADEMARK OFFICE

CERTIFICATE OF CORRECTION

PATENT NO. : 5,903,519

DATED : May 11, 1999

INVENTOR(S) : Masaaki TAKAHASHI et al.

It is certified that error appears in the above-indentified patent and that said Letters Patent is hereby corrected as shown below:

COLUMN 10

Line 18, --the balance 70,-- should be inserted after "30,".
Line 19, "the balance 70, the setting lever 120 and the yoke 130" should read --the yoke 130 and the setting lever 120--.
Line 29, "the balance" should be deleted and --the balance 70,-- should be inserted before "the pallet fork 60,".
Line 30, "70, the setting lever 120 and the yoke 130" should read --the yoke 130 and the setting lever 120--.

IN CLAIM 5, COLUMN 12

Line 45, --the balance,-- should be inserted after "member,".
Line 46, "the balance," should be deleted.

Signed and Sealed this

Eighteenth Day of January, 2000

*Attest:*

Q. TODD DICKINSON

*Attesting Officer*

*Commissioner of Patents and Trademarks*